United States Patent [19]

Baran et al.

[11] Patent Number: 4,673,181

[45] Date of Patent: Jun. 16, 1987

[54] SKILL ACTION GAME

[75] Inventors: Patrick S. Baran; Sandra A. Levin, both of Chicago; Wayne A. Kuna, River Forest, all of Ill.

[73] Assignee: Marvin Glass & Associates, Chicago, Ill.

[21] Appl. No.: 827,343

[22] Filed: Feb. 7, 1986

[51] Int. Cl.[4] ..... A63F 9/00

[52] U.S. Cl. ..... 273/1 GC; 273/1 GG

[58] Field of Search ..... 273/1 GC, 1 GG, 383, 273/384, 377, 371

[56] References Cited

U.S. PATENT DOCUMENTS

| | | | |
|---|---|---|---|
| 2,460,146 | 1/1949 | Prentice | 273/1 GC |
| 4,039,184 | 8/1977 | Breslow et al. | 273/1 GC |
| 4,300,762 | 11/1981 | Goldfarb et al. | 273/1 GG |
| 4,326,709 | 4/1982 | Croyle | 273/1 GG X |
| 4,502,691 | 3/1985 | Ratliff et al. | 273/384 X |

FOREIGN PATENT DOCUMENTS

| | | | |
|---|---|---|---|
| 2250288 | 5/1975 | France | 273/1 GG |

*Primary Examiner*—Paul E. Shapiro
*Attorney, Agent, or Firm*—John S. Pacocha

[57] ABSTRACT

A skill action game in which players try to remove cards from an opening without tripping a mechanical action feature. In order to remove the cards, players must use an electrically conductive probe. If the probe is allowed to contact a conductive strip a circuit will be completed to energize a motor which will move a latch to release a biased mechanical action. Simultaneous movement of two action features in substantially opposite directions is affected by spaced apart facing rack teeth carried by each of the features engaging a gear.

15 Claims, 9 Drawing Figures

SKILL ACTION GAME

BACKGROUND OF THE INVENTION

1. Field of the Invention

This invention relates generally to skill action games and more particularly to games in which players attempt to collect items without triggering an unwanted result.

2. Background Art

Skill action games such as the game of "Pick-Up Sticks" in which players attempt to collect items without triggering an unwanted result are old in the art. The "Operation" game, in which players utilize electrically conductive tweezers to remove items from openings without touching an electrically conductive edge that would set off a buzzer, has been popular for many years. Another skill action game utilizing an electrical probe is disclosed in U.S. Pat. No. 3,333,846. However, there remains a need for such entertaining skill action games.

SUMMARY OF THE INVENTION

The present invention is concerned with providing an entertaining skill action game. This and other objects and advantages of the invention are achieved in a game having a housing with a number of recesses, each capable of receiving a card. An electrically conductive probe is provided for players to try and extricate the cards from their respective recesses by manipulating the probe within a slot that is in communication with the recesses. However, should the player contact a conductive strip disposed behind the slot, an electrical circuit will be completed between a battery power source and a DC motor. Energization of the motor moves a latch to release a biased mechanical action feature signaling the end of the player's turn. More particularly, two features are urged to move in substantially opposite directions by a single bias when the latch is released. Each of the movable features has a rack with substantially the same teeth facing each other and spaced apart from each other. A freely rotating gear is in engagement with the teeth of both racks so that movement of one rack effects movement of the other in substantially the opposite direction.

BRIEF DESCRIPTION OF THE DRAWINGS

For a better understanding of the present invention reference may be had to the accompanying drawing in which.

DETAILED DESCRIPTION OF THE PREFERRED EMBODIMENT

Figures 1, 2, 3, 4, 5, 6, 7, 8, 9:
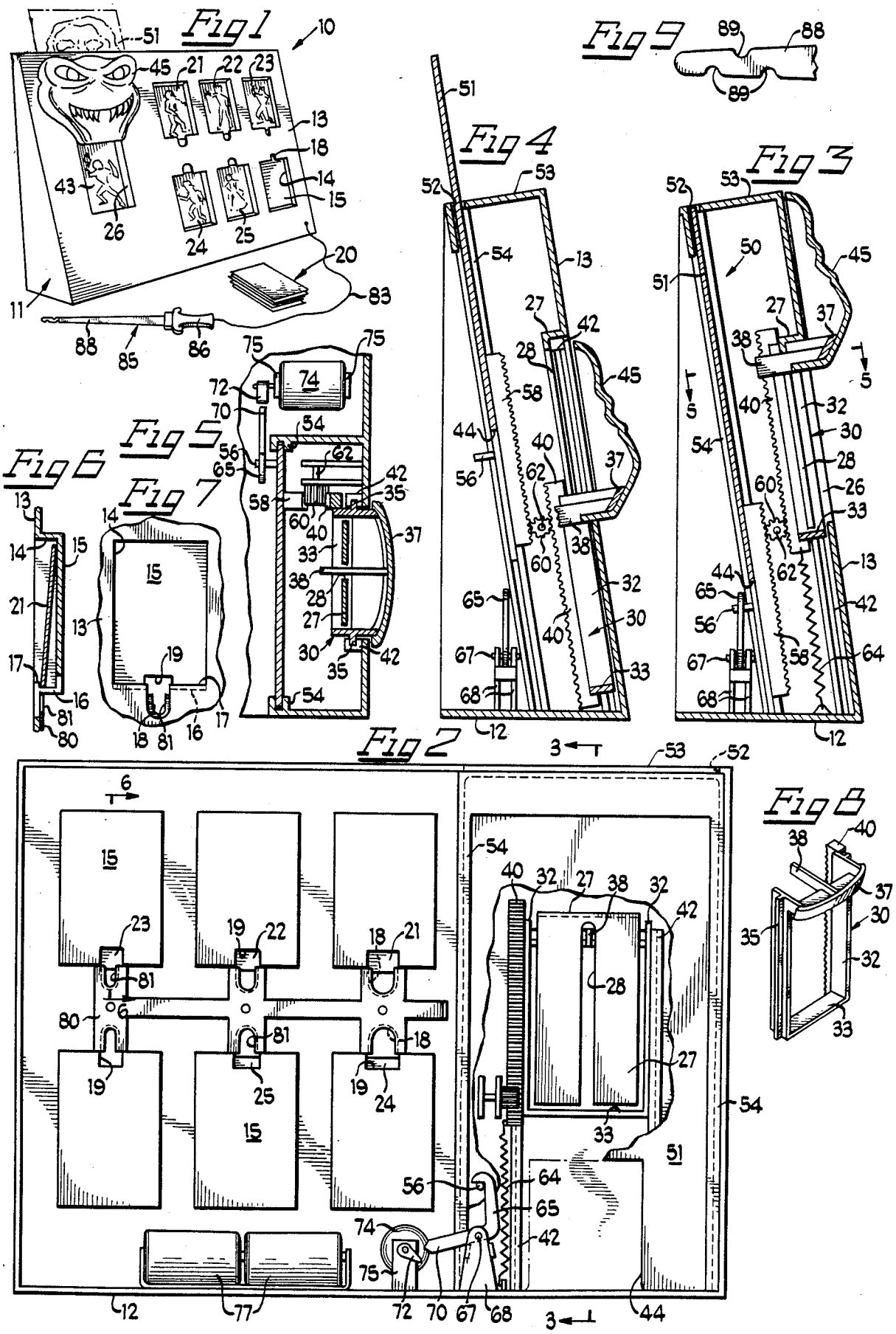
FIG. 1 is a perspective view of an embodiment of the present invention.
FIG. 2 is an enlarged rear elevational view, partially broken away.
FIG. 3 is a sectional view taken generally along line 3—3 of FIG. 2.
FIG. 4 is a sectional view similar to FIG. 3 but showing some of the parts in another position.
FIG. 5 is a sectional view taken generally along line 5—5 of FIG. 3.
FIG. 6 is a sectional view taken generally along line 6—6 of FIG. 2.
FIG. 7 is a fragmentary front elevational view of the part through which the section of FIG. 6 is taken.
FIG. 8 is a perspective view of part of the mechanism.
FIG. 9 is an enlarged fragmentary view of part of the probe.

Referring now to the drawings in which like parts are designated by like reference numerals throughout the several views, FIG. 1 shows a game 10 including a housing 11 having a generally planar bottom 12. Housing 11 includes a rearwardly and upwardly inclined front panel 13. Part of panel 13 is taken up by two rows of three generally rectangular openings 14. Behind each opening 14, there is a recessed back wall 15 with a lower ledge 16 extending between panel 13 and back wall 15. Panel 13 extends a short distance above ledge 16 to form a lip 17.

Along either a lower or upper edge of each opening 14, there is a slot 18 approximately midway along the edge. As illustrated in FIGS. 1 and 2, the three upper openings have a slot 18 in the bottom edge while the three lower openings have the slot in the upper edge. In addition, the back wall is provided with a notch 19 along either its upper or lower edge so that the notch is in line with the respective slot 18. The aligned slot 18 and notch 19 for each opening 14, or as illustrated in FIG. 2, for each set of vertically related upper and lower openings, may be of a different width from the slot and notch of other openings.

A supply of cards 20, each with a character depicted on one face, are included in game 10. Openings 14 are all of the same uniform size and are adapted to receive one of the cards 20. Thus, one of the cards may be placed within an opening 14 with the lower edge of the card resting upon ledge 16 and retained within the opening by lip 17. As illustrated in FIGS. 1 and 2, each one of the three upper openings and two of the lower openings have a respective card 21, 22, 23, 24 or 25.

Another generally rectangular opening 26, which is larger than openings 14 in the generally vertical dimension, is provided in another part of panel 13. Behind opening 26 is a recessed back wall 27 with a generally centrally disposed slit 28 that is open at the bottom and extends almost all the way up to the top of back wall 27. Disposed behind opening 26, between panel 13 and back wall 28, is a carrier 30. The carrier includes a generally "U" shaped frame with spaced apart uprights 32 and a lower, generally horizontal, ledge 33. The uprights are spaced apart a distance greater than the width of opening 26.

On the outer side of each of the uprights, approximately in the middle of the width of each upright, is a rail 35 extending substantially along the length of the upright. Spanning across the top of uprights 32 is a bridge 37 with a, generally centrally disposed, rearwardly extending guide bar 38. One of the uprights has an attached, or integrally formed, rack 40 on the outside of the upright with the teeth of the rack directed rearwardly in the same general direction as guide bar 38. Attached to the back of panel 13 on either side of opening 26 are facing channels 42. Each of the channels receives a respective one of the rails 35. Thus, carrier 30 is mounted for up and down movement behind panel 13 with guide bar 38 riding in slot 28.

A card 43 inserted through opening 26 has its lower edge resting atop piece 33 and its upper edge leaning back against slotted wall 27. There is sufficient room between bridge 37 and the top of card 43 for insertion of a player's finger to remove the card. Card 43 is received between horizontal piece 33 and guide bar 38 so that when carrier 30 moves down, guide bar 38 pushes card 43 down with the carrier. When carrier 30 is in the lowermost position, card 43 drops backwardly out of the carrier. An access opening 44 is provided in the back of housing 11 for collection of a dropped card. Atop bridges 37 there is a three dimensional, sculptured head 45 which moves up and down along the outside front of panel 13 as carrier 30 moves up and down behind the panel.

Also disposed generally behind opening 26, but spaced from carrier 30, is a flag mechanism 50. The flag mechanism includes a pop-up piece 51 that is mounted for up and down movement in a plane substantially parallel to both a plane of up and down movement of carrier 30 and the plane of front panel 13. Pop-up piece 51 is movable to a position above housing 11 through a slot 52 in the top wall 53 of housing 11. Spaced apart facing channels 54 receive the pop-up piece 51 for the up and down movement. Extending rearwardly from the pop-up piece is a pin 56.

The front side of piece 51 has a rack 58 that is substantially aligned with rack 40 of carrier 30. The teeth of racks 40 and 58, which face each other and are spaced apart, have teeth of the same pitch and of the same number per inch. Between racks 40 and 58, and in engagement with the teeth of each of the racks, is a gear 60 that freely rotates on a shaft 62. As illustrated in FIG. 3, when carrier 30 is in its raised position and pop-up piece 51 in its lowered position, gear 60 is in engagement with teeth adjacent the lower end of rack 40 and teeth adjacent the upper end of rack 58. Conversely, when carrier 30 is in its lower position and the pop-up piece 51 in its raised position, as illustrated in FIG. 4, gear 60 is in engagement with teeth adjacent the upper end of rack 40 and teeth adjacent the lower end of rack 58.

Carrier 30 is biased to the lower position by a compression spring 64 extending between the lower end of rack 40 and bottom 12 of housing 11. Maintaining carrier 30 in its raised position against the bias of 64, and at the same time maintaining pop-up piece 51 in its lowered position within housing 11, is a latch hook 65 that engages pin 56. The latch hook is mounted for pivotal movement about an axle 67 journaled between two brackets 68 extending upwardly from the bottom of housing 11.

Latch hook 65 includes an extending lever arm 70, the weight of which biases the latch hook back to its pin engaging position so that merely pushing down on pop-up piece 51 will reengage latch hook 65 in pin 56 after a release. Lever arm 70 has its free end in proximity to, and acts as a follower of, cam 72 which is driven by a small DC motor 74. Both the motor and cam are mounted on blocks 75 attached to the inside bottom of housing 11. Also mounted on the bottom of the housing are a pair of batteries 77.

On the back of table 13 is an electrical contact strip 80 having "U" shaped openings 81 that are slightly smaller than, and aligned with, respective slots 18. By conventional wiring (not shown) one terminal of the batteries is connected to the motor and contact strip 80 is also connected to motor 74. The other terminal of batteries 77 is connected by wire 83 extending out of housing 11 to an electrical probe in the form of a sword 85. The sword is provided with a handle 86 that is preferably covered with an insulating material. As is best shown in FIG. 9, the tip of the sword blade 88 is formed with a number of notches 89.

In play, one of each of the cards 20 is initially placed face down in each recess through its respective opening 14 and a card is placed face up through opening 26 on ledge 33 of carrier 30. A player then tries to remove the cards through openings 14 to match the face up card visible through opening 26 by inserting sword blade 88 through the slot and notch of an opening to engage an edge of the card with one of the notches 89 and then pull the card out of the opening. Should the player contact an edge of one of the "U" shaped openings 81 with the sword blade, an electrical circuit will be completed to energize motor 74. When 74 rotates, it will drive cam 72 into engagement with the lever end 70 of latch hook 65 and release pin 56. The bias of spring 64 will then pull carrier 30 down and as rack 40 moves down gear 60 will rotate driving rack 58 up to move pop-up piece 51 out through slot 52. Downward movement of carrier 30 will also move head 45 down and cover opening 26. The sudden, surprising, unwanted result of piece 51 popping up and opening 26 being shut signals the end of a player's turn. The game is then reset by pushing down on pop-up piece 51 and putting cards back into whatever openings the previous player was able to remove a card from before making the electrical contact with sword 85.

While a particular embodiment of the present invention has been shown and described, changes and modifications will occur to those skilled in the art. It is intended in the appended claims to cover all such changes and modifications as fall within the true spirit and scope of the present invention.

What is claimed as new and desired to be secured by Letters Patent is:

1. A game comprising:
a housing;
an electric motor within the housing;
a power source contained in the housing for the electric motor;
a biased mechanical action feature carried by the housing
means releasably latching the action feature against the bias;
means driven by the motor releasing the latch means;
a plurality of slots in the housing;
an electrical contact strip disposed behind the slots;
a player manipulatable electrically conductive probe in electrical contact with the power source;
the probe being selectively insertable by the player into the slots;
contact between the probe and the strip completing an electrical circuit to energize the motor to release the latch means;
cards;
a plurality of recesses in the housing, each recess in communication with one of the slots and each recess being capable of receiving one of the cards;
means on the probe for removing a card from a respective recess by manipulating the probe within the slot; and
the means for removing the card including a blade with notches, the blade being selectively insertable into each slot.

2. The game of claim 1 in which the mechanical action feature includes a piece that pops up above the housing.

3. The game of claim 2 in which:
the housing includes a opening; and the mechanical action feature also includes a piece that closes the opening.

4. The game of claim 2 in which:

the housing includes an opening; and the mechanical action feature includes a card carrier that is registrable with the opening in the housing and the carrier moves out of register with the opening upon release of the latch means.

5. The game of claim 4 in which:

the mechanical action feature also includes pieces moving in substantially opposite directions;

each piece has a rack;

the racks have substantially the same teeth spaced apart and facing each other;

gear means are disposed between the teeth of each of the racks and in engagement with the teeth of each of the racks; and the biasing means are connected to only one of the pieces.

6. A game comprising:

a housing;

an electric motor within the housing;

a power source contained in the housing for the electric motor;

a biased mechanical action feature carried by the housing;

means releasably latching the action feature against the bias;

means driven by the motor releasing the latch means;

a plurality of slots in the housing;

an electrical contact strip disposed behind the slots;

a player manipulatable electrically conductive probe in electrical contact with the power source;

the probe being selectively insertable by the player into the slots;

contact between the probe and the strip completing an electrical circuit to energize the motor to release the latch means;

an opening in the housing; and the mechanical action feature including a carrier that is registrable with the opening in the housing, the carrier moving out of register with the opening upon release of the latch means.

7. The game of claim 6 in which:

cards are included; and at least one of the cards is receivable in the carrier.

8. The game of claim 6 in which the mechanical action feature also includes a piece that closes the opening.

9. The game of claim 8 in which the mechanical action feature also includes another piece that pops up above the housing.

10. The game of claim 9 in which:

both pieces move in substantially opposite directions;

each piece has a rack;

the racks have substantially the same teeth spaced apart and facing each other;

gear means are disposed between the teeth of each of the racks and in engagement with the teeth of each of the racks; and the biasing means are connected to only one of the pieces.

11. A game comprising:

a housing;

an electric motor within the housing;

a power source contained in the housing for the electric motor;

a biased mechanical action feature carried by the housing;

means releasably latching the action feature against the bias;

means driven by the motor releasing the latch means;

a plurality of slots in the housing;

an electrical contact strip disposed behind the slots;

a player manipulatable electrically conductive probe in electrical contact with the power source;

the probe being selectively insertable by the player into the slots;

contact between the probe and the strip completing an electrical circuit to energize the motor to release the latch means;

an opening in the housing; and the mechanical action feature including a piece that closes the opening.

12. The game of claim 11 in which the mechanical action feature also includes a piece that pops up above the housing.

13. The game of claim 12 in which:

both pieces move in substantially opposite directions;

each piece has a rack;

the racks have substantially the same teeth spaced apart and facing each other;

gear means are disposed between the teeth of each of the racks and in engagement with the teeth of each of the racks; and the biasing means are connected to only one of the pieces.

14. A game comprising:

a housing;

an electric motor within the housing;

a power source contained in the housing for the electric motor;

a biased mechanical action feature carried by the housing;

means releasably latching the action feature against the bias;

means driven by the motor releasing the latch means;

a plurality of slots in the housing;

an electrical contact strip disposed behind the slots;

a player manipulatable electrically conductive probe in electrical contact with the power source;

the probe being selectively insertable by the player into the slots;

contact between the probe and the strip completing an electrical circuit to energize the motor to release the latch means;

the mechanical action feature including pieces moving in substantially opposite directions;

each piece having a rack;

the racks having substantially the same teeth spaced apart and facing each other;

gear means disposed between the teeth of each of the rack and in engagement with the teeth of each of the racks; and the biasing means connected to only one of the pieces.

15. The game of claim 14 in which:

the housing includes an opening; and one of the pieces includes a carrier that is registrable with the opening in the housing and the carrier moves out of register with the opening upon release of the latch means.

* * * * *